US008076562B1

(12) United States Patent
Lin

(10) Patent No.: US 8,076,562 B1
(45) Date of Patent: Dec. 13, 2011

(54) DOUBLE PEDAL PERCUSSION INSTRUMENT

(76) Inventor: Hsi-Tan Lin, Daya Shiang (TW)

( * ) Notice: Subject to any disclaimer, the term of this patent is extended or adjusted under 35 U.S.C. 154(b) by 0 days.

(21) Appl. No.: 12/877,448

(22) Filed: Sep. 8, 2010

(51) Int. Cl.
*G10D 13/02* (2006.01)

(52) U.S. Cl. ..... 84/422.1

(58) Field of Classification Search ..... 84/422.1, 84/422.2, 422.3
See application file for complete search history.

(56) References Cited

U.S. PATENT DOCUMENTS 6,255,574 B1 * 7/2001 Sapienza ..... 84/422.1

* cited by examiner

*Primary Examiner* — Kimberly Lockett

(57) ABSTRACT

A double pedal percussion instrument of the present invention has a bottom plate and a pedal plate. The bottom plate includes a rear plate and a front plate. The rear plate is rotatably connected to the front plate about an axial pole. A rear end of the pedal plate and the rear plate are in an operative relationship. As such, the pedal plate is rotatable with respect to the front plate. The position of the pedal plate is adjustable.

6 Claims, 5 Drawing Sheets

DOUBLE PEDAL PERCUSSION INSTRUMENT

BACKGROUND OF THE INVENTION

1. Field of the Invention

The present invention relates to a pedal assembly for a percussion instrument.

2. Description of the Prior Art

Pedal assemblies are used for beating the drum head of a base drum, such as the foot pedal shown in US20040020345. The foot pedal includes a base plate, a pedal and a heel. The base plate is formed with an arc-shaped guide groove. The heel is movably mounted on the base plate, so that the heel is movable along the are-shaped guide groove. The pedal is pivotably coupled to the heel. As such, the pedal is movable with respect to the base plate between a left position and a right position.

The adjusting angle of the pedal between the left position and the right position is determined by the guide groove. The guide groove is near to the rear end of the pedal plate. As a result, the position of the foot pedal is limited. It is difficult to make the adjusting angle bigger. More specifically, a bigger guide groove and a bigger base plate must be prepared for a bigger adjusting angle. This kind of foot pedal is difficult to be stored, carried or installed.

Some pedal assemblies, such as the pedal assembly shown in FIG. 5, have two pedals. Such pedal assembly is adapted for user to play with two feet. To fit with user's feet, the pedals are usually placed in fan-shaped. The linkage connected between the pedals has to include two universal joints. As a result, the cost of the pedal assembly will rise. Moreover, the universal joints are usually provided with tolerance, so that the pedals are loose.

The present invention is, therefore, arisen to obviate or at least mitigate the above mentioned disadvantages.

SUMMARY OF THE INVENTION

The main object of the present invention is to provide another pedal assembly with an adjustable pedal, which has an enlarged adjusting angle.

To achieve the above and other objects, a double pedal percussion instrument of the present invention includes two pedal units and a linkage. The linkage connects one of the pedal units to the other one.

Every pedal unit comprises a base, a pedal plate, a bottom plate, a transmission member, an axial pole and a fixation threaded member. The transmission member is connected to a front end of the pedal plate. The bottom plate comprises a front plate and a rear plate. The base is firmly disposed on the front plate. A rear end of the pedal plate and the rear plate are in an operative relationship. The pedal plate is pivotable with respect to the bottom plate. The axial pole connects the rear plate to the front plate. The rear plate is rotatable about the axial pole with respect to the front plate.

The rear plate is formed with an arc-shaped groove. An arc center of the groove is located on the axial pole. The fixation threaded member passes through the groove. The fixation threaded member is disposed on the front plate. The fixation threaded member is adapted for limiting a position of the rear plate with respect to the front plate.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
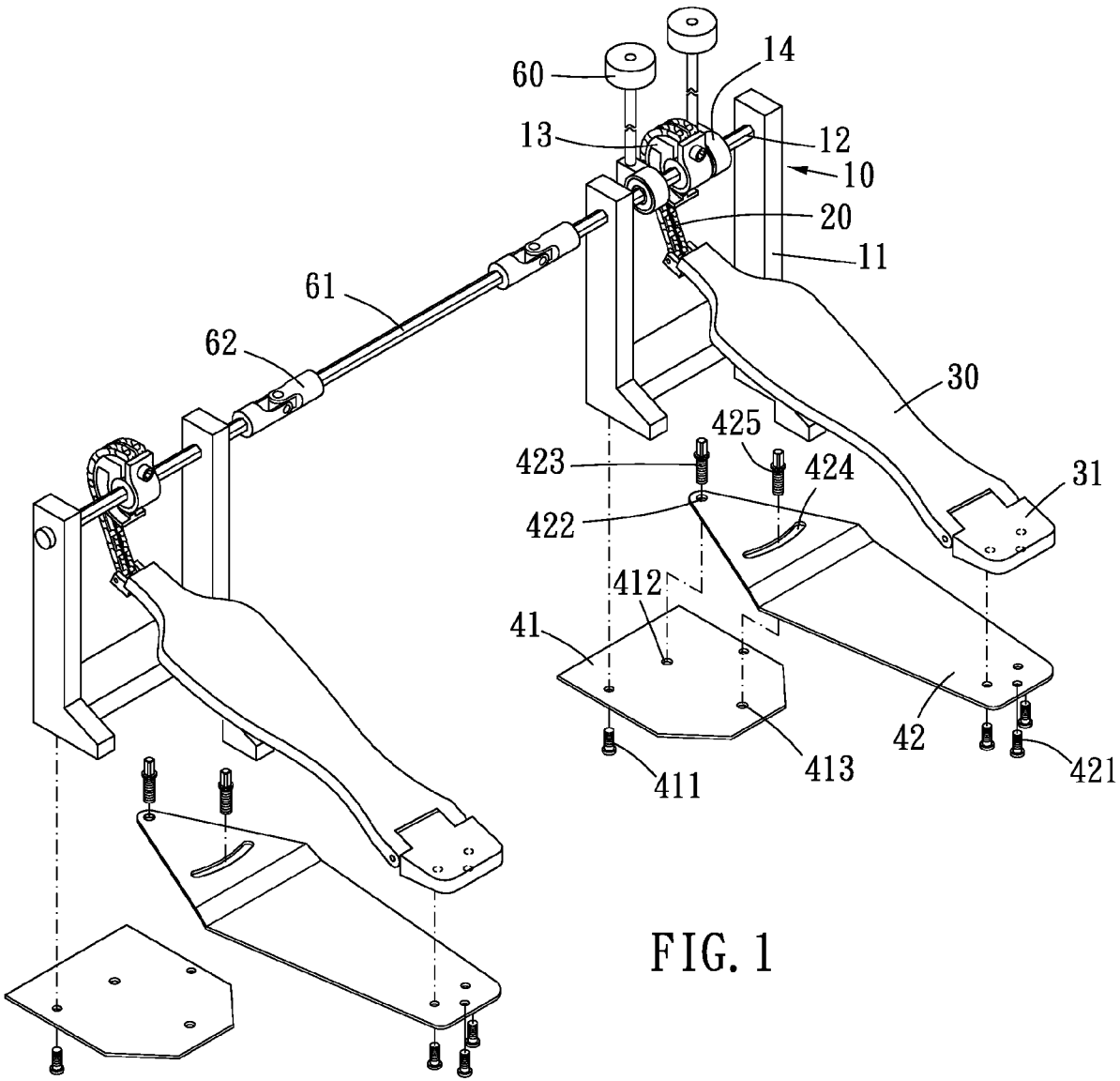
FIG. 1 is a partial breakdown drawing showing a preferred embodiment of the present invention.
Figure 2:
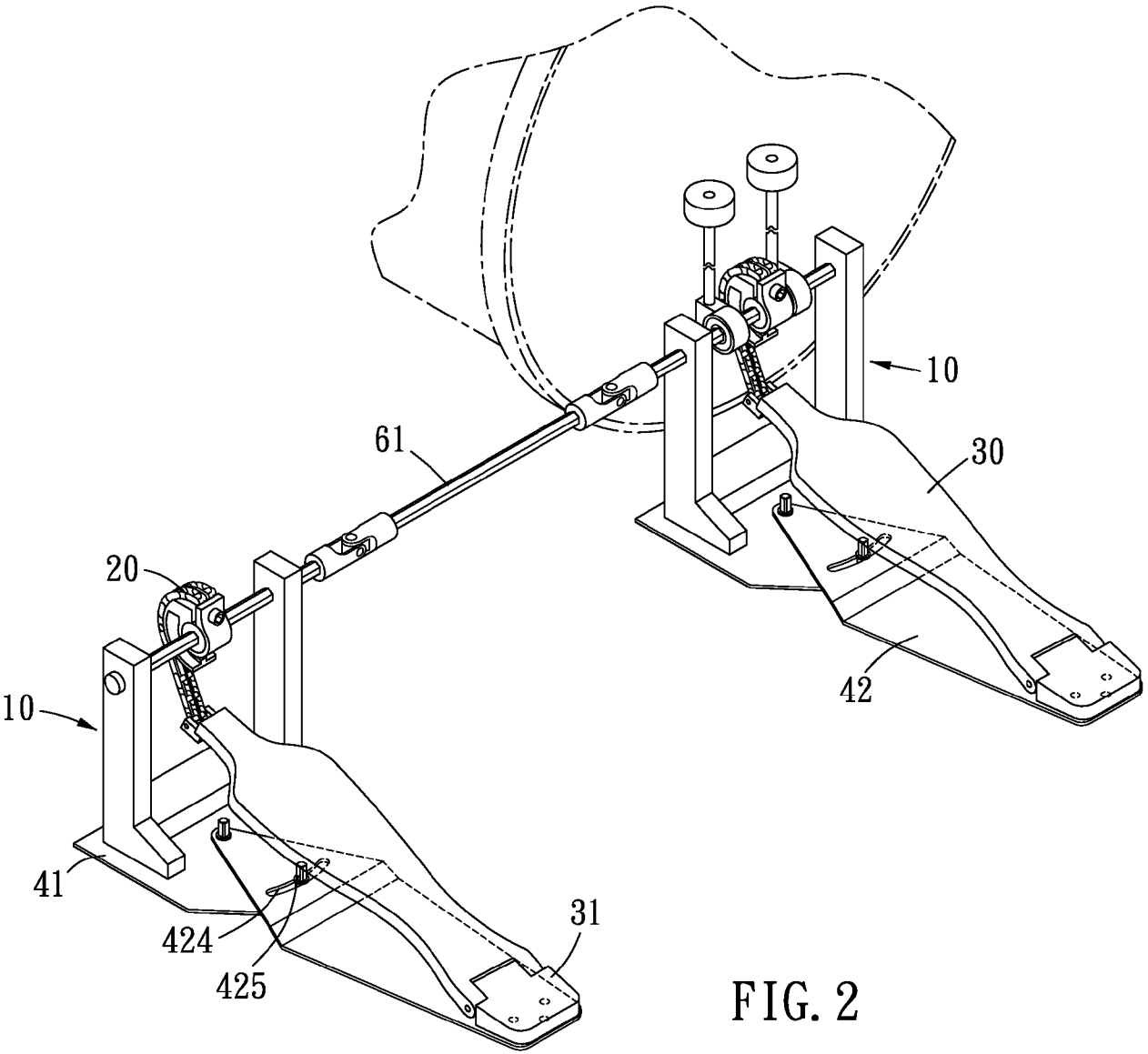
FIG. 2 is a stereogram showing a preferred embodiment of the present invention.

Please refer to FIG. 1 to FIG. 4 for a preferred embodiment of the present invention. The double pedal percussion instrument of the present embodiment may be assembled with a base drum. In other possible embodiments of the present invention, the double pedal percussion instrument may be used with other percussion instrument. The double pedal percussion instrument includes two pedal units and a linkage 61. The linkage 61 connects one of the pedal units to the other one.

Every pedal unit includes a base 10, a bottom plate, a pedal plate 30, a transmission member 20, an axial pole 423 and a fixation threaded member 425.

The base 10 has two supporting arms 11, a shaft 12, a cam mechanism 13 and a hammer holder 14. The shaft 12 is rotatably connected one of the supporting arms 11 to the other one. The shaft 12 is located on the top ends of the supporting arms 11. The cam mechanism 13 is disposed on the shaft 12. The hammer holder 14 is disposed on the shaft 12. The cam mechanism 13, the hammer holder 14 and the shaft 12 are in a rotational operative relationship. The hammer holder 14 is adapted for a hammer 60 to be assembled thereon. As such, the hammer 60 pivots about the shaft 12 when the cam mechanism 13 rotates.

The bottom plate includes a front plate 41 and a rear plate 42. A rear end of the pedal plate 30 is pivotably connected to a heel plate 31, and the heel plate 31 is firmly disposed on the rear plate 42 by plurality of threaded pieces 421. As such, the pedal plate 30 is pivotable with respect to the bottom plate. In other possible embodiments of the present invention, the pedal plate 30 may be directly pivotably connected to the rear plate 42. As such, the rear end of the pedal plate 30 and the rear plate 42 are in an operative relationship. The base 10 is firmly disposed on the front plate 41 by plurality of threaded pieces 411.

The axial pole 423 connects the rear plate 42 to the front plate 41. The rear plate 42 is rotatable about the axial pole 423 with respect to the front plate 41. In the present embodiment, the rear plate 42 is formed with a hole 422. The hole 422 is located on a front end of the rear plate 42. The front plate 41 is formed with a threaded hole 412. The axial pole 423 passes through the hole 422, and is screwed in the threaded hole 412.

The rear plate 42 is formed with an arc-shaped groove 424. The arc center of the groove 424 is located on the axial pole 423. The fixation threaded member 425 passes through the groove 424 and is disposed on the front plate 41. In the present embodiment, the front plate 41 is formed with another threaded hole 413. The fixation threaded member 425 is screwed in the threaded hole 413. As such, the fixation threaded member 425 is adapted for limiting the position of the rear plate 42 with respect to the front plate 41. The front plate 41 and the rear plate 42 may be fixed by fastening the fixation threaded member 425.

The transmission member 20 connects a front end of the pedal plate 30 to the cam mechanism 13, so that the cam mechanism 13 rotates when the pedal plate 30 pivots with respect to the bottom plate. The transmission member 20 is a chain. In other possible embodiment of the present invention, the transmission member may be a belt or a linkage.

The linkage 61 connects one of the pedal units to the other one. More particularly, two universal joints 62 may be disposed on two ends of the linkage 61. The universal joints 62 are individually connected to the shaft 12 of one of the pedal units. As such, the linkage 61 and the shafts 12 of the pedal units are in a rotational operative relationship. In other possible embodiments of the present invention, the linkage may directly connect one of the pedal units to the other one.

Figure 3:
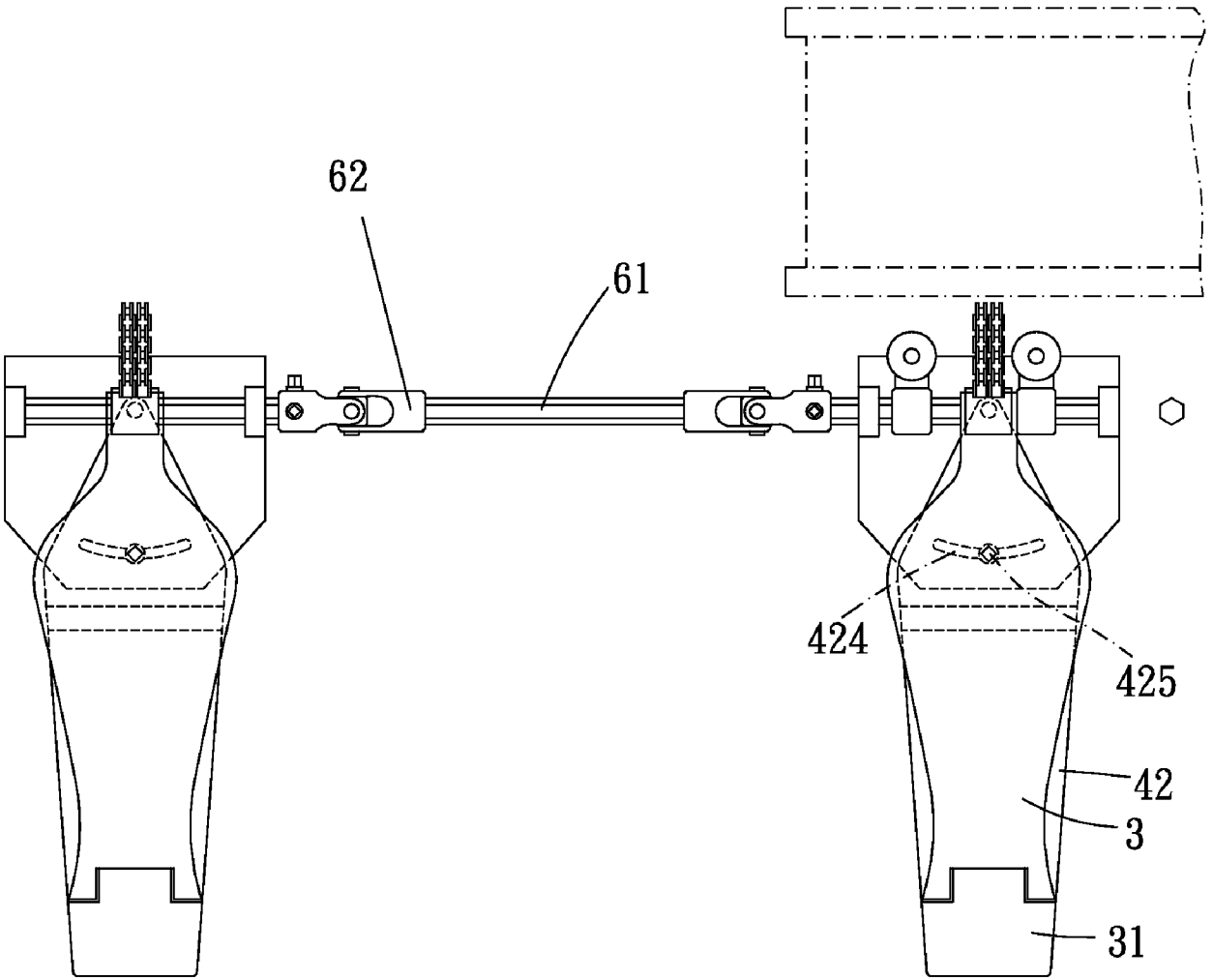
FIG. 3 is a vertical view showing a preferred embodiment of the present invention.
Figure 4:
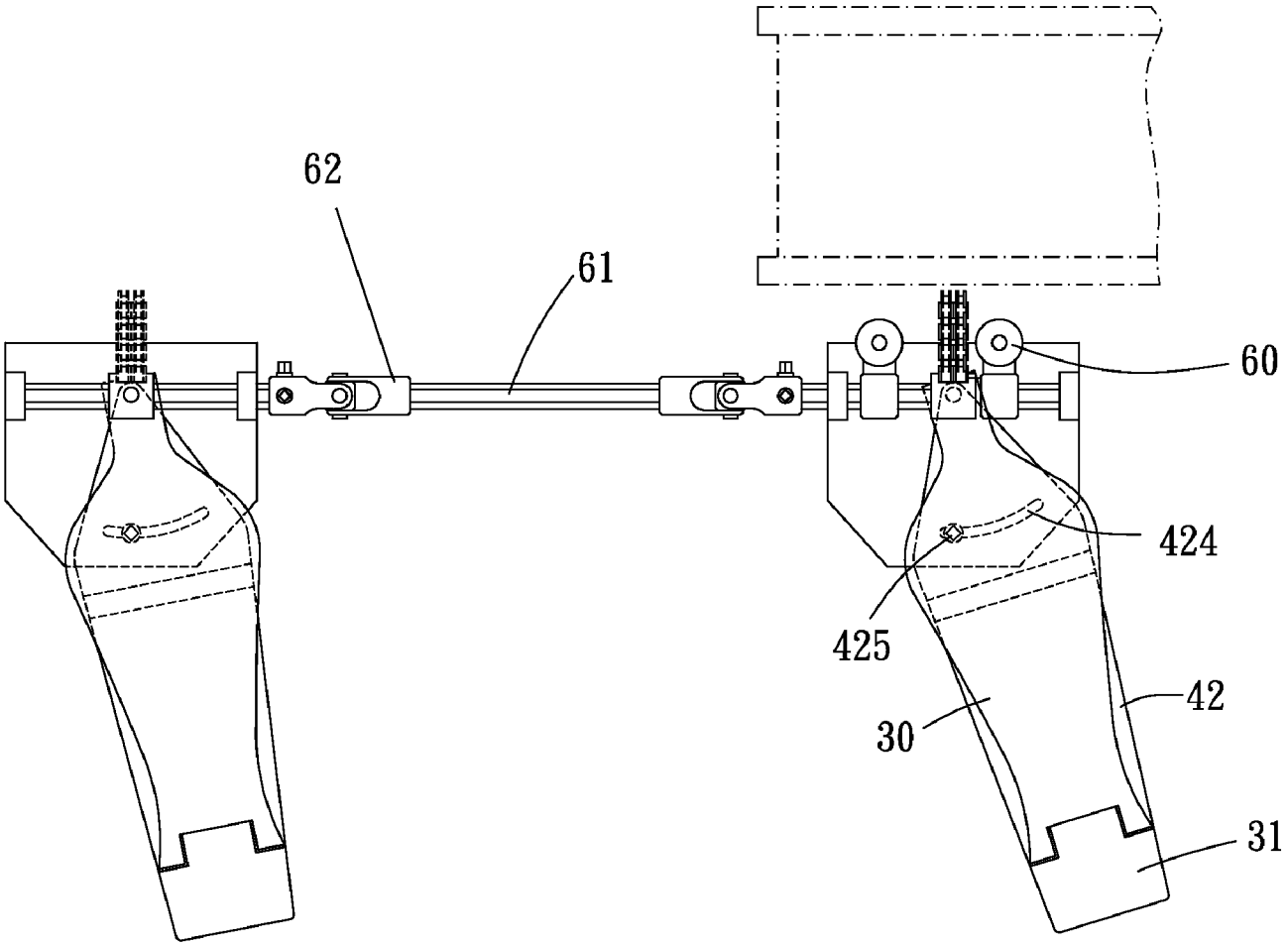
FIG. 4 is a vertical view showing a preferred embodiment of the present invention.
Figure 5:
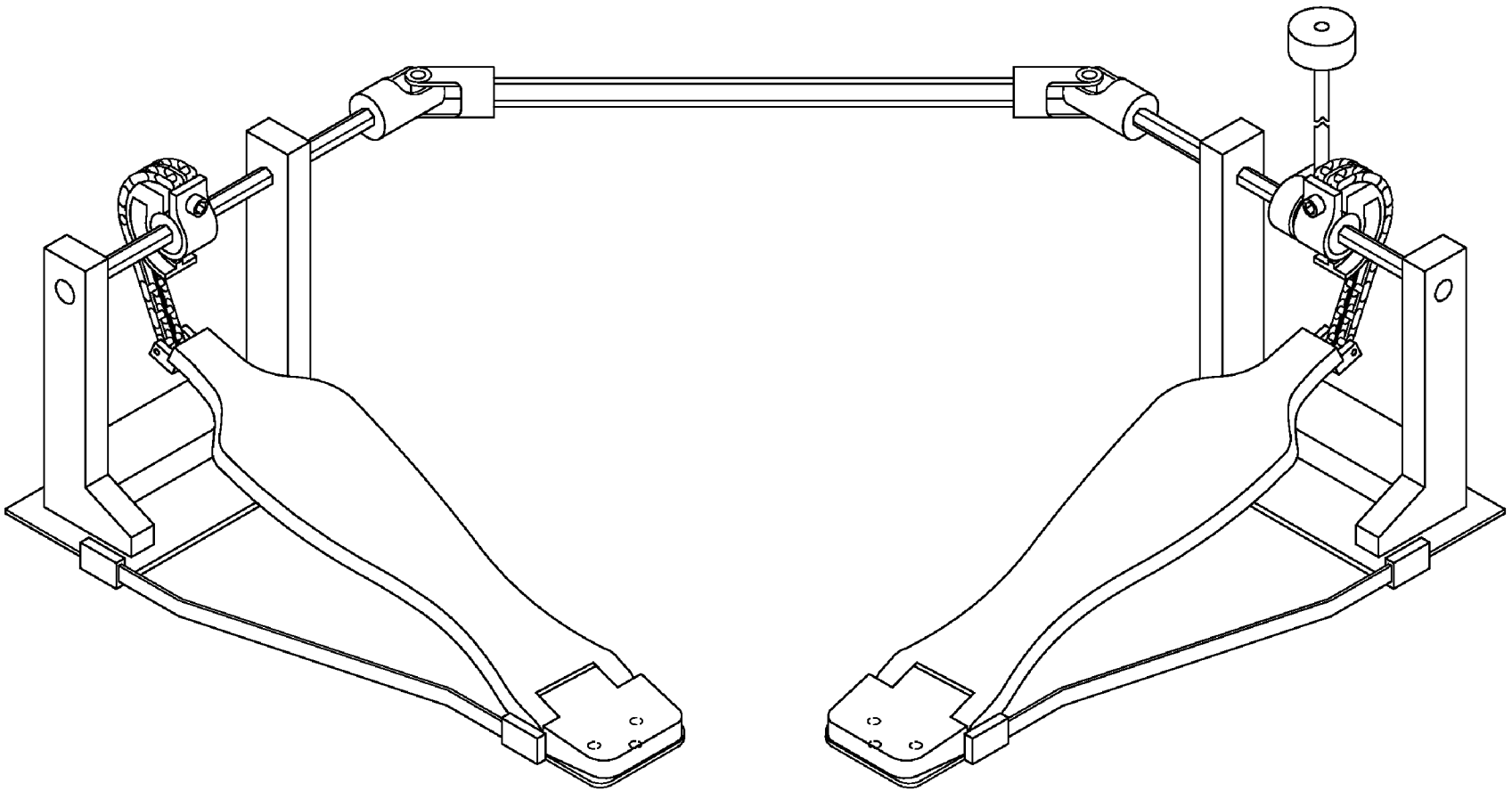
FIG. 5 PRIOR ART
FIG. 5 is a perspective view showing a conventional pedal assembly.

Accordingly, please refer to FIG. 3 and FIG. 4. The rear plate 42 is rotatable about the axial pole 423 when the fixation threaded member 425 is loosened. The pedal plate 30 can be moved with the rear plate 42. As such, the position of the pedal plate 30 is adjustable.

In the present invention, the groove 424 is away from the heel plate 31 or the rear end of the pedal plate 30. Although the groove 424 and the bottom plate are not enlarged, the pedal plate can still be adjusted in a large space. Moreover, each one of the pedal plates 30 can be individually adjusted. As such, the pedals can be placed is fan-shaped without a universal joint.

What is claimed is:

1. A double pedal percussion instrument, comprising two pedal units and a linkage, the linkage connecting one of the pedal units to the other one, wherein:

every pedal unit comprises a base, a pedal plate, a bottom plate, a transmission member, an axial pole and a fixation threaded member, the transmission member is connected to a front end of the pedal plate, the bottom plate comprises a front plate and a rear plate, the base is firmly disposed on the front plate, a rear end of the pedal plate and the rear plate are in an operative relationship, the pedal plate is pivotable with respect to the bottom plate, the axial pole connects the rear plate to the front plate, the rear plate is rotatable about the axial pole with respect to the front plate;

the rear plate is formed with an arc-shaped groove, an arc center of the groove is located on the axial pole, the fixation threaded member passes through the groove, the fixation threaded member is disposed on the front plate, the fixation threaded member is adapted for limiting a position of the rear plate with respect to the front plate.

2. The double pedal percussion instrument of claim 1, wherein the rear plate is formed with a hole, the hole is located on a front end of the rear plate, the front plate is formed with a threaded hole, the axial pole passes through the hole, the axial pole is screwed in the threaded hole.

3. The double pedal percussion instrument of claim 1, wherein the front plate is formed with a threaded hole, the fixation threaded member is screwed in the threaded hole.

4. The double pedal percussion instrument of claim 1, wherein the base has two supporting arms, a shaft is rotatably connected between the supporting arms' top ends, a cam mechanism and a hammer holder are disposed on the shaft, the cam mechanism, the hammer holder and the shaft are in a rotational operative relationship, the transmission member is connected the cam mechanism to the pedal plate, so that the cam mechanism rotates when the pedal plate pivots with respect to the bottom plate, the rear end of the pedal plate is pivotally connected to a heel plate, the heel plate is firmly disposed on the rear plate.

5. The double pedal percussion instrument of claim 4, wherein the base is firmly disposed on the front plate by plurality of threaded pieces, the heel plate is firmly disposed on the rear plate by plurality of threaded pieces.

6. The double pedal percussion instrument of claim 1, wherein two universal joints are disposed on two ends of the linkage, the universal joints are individually connected to the shaft of one of the pedal units.

* * * * *